US006874186B2

(12) United States Patent
Lin

(10) Patent No.: US 6,874,186 B2
(45) Date of Patent: Apr. 5, 2005

(54) LIFE-SAVING HAMMER STRUCTURE

(76) Inventor: Mei-Ling Lin, 101 Denslowe Dr., San Francisoco, CA (US) 94132

( * ) Notice: Subject to any disclaimer, the term of this patent is extended or adjusted under 35 U.S.C. 154(b) by 189 days.

(21) Appl. No.: 10/227,867

(22) Filed: Aug. 27, 2002

(65) Prior Publication Data

US 2004/0040094 A1 Mar. 4, 2004

(51) Int. Cl.[7] ..... B25D 1/04
(52) U.S. Cl. ..... 7/144; 7/100; 81/20
(58) Field of Search ..... 7/100, 144; 81/20

(56) References Cited

U.S. PATENT DOCUMENTS 5,642,567 A * 7/1997 Lin ..... 7/100
5,903,942 A * 5/1999 Hasegawa ..... 7/144

* cited by examiner

*Primary Examiner*—James G. Smith
(74) *Attorney, Agent, or Firm*—Bacon & Thomas

(57) ABSTRACT

An improved life-saving hammer structure. The structure mainly includes left and right housings, a hammer head, a counterweight block, and a blade wherein the left and right housings are counterparts to be engaged for the hammer head and the counterweight block to be encased thereto via a pair of left and right transverse arc coupling heads disposed at the upper section thereof. The left and right housings also include a middle section with a multiple of equidistant engaging holes disposed thereon, and a staged lower section with a left and a right handles of unequal lengthy extending downwards at the bottom thereof respectively. The left and right handles are equipped with staged stop flanges for left and right cover bodies to be engaged therein respectively.

1 Claim, 5 Drawing Sheets

LIFE-SAVING HAMMER STRUCTURE

BACKGROUND OF THE INVENTION

The present invention is related to an improved life-saving hammer structure, comprising a left and a right housings, a hammer head, a counterweight block, and a blade wherein said left and right housings are counterparts to be engaged for said hammer head and said counterweight block to be encased thereto at the upper section thereof, and for said blade to be adapted at the proper space disposed at the lower section thereof. Said hammer head, facilitated by said counterweight block, can easily and quickly smash glasses for the purpose of life-saving, and said blade, received at the proper space thereof, can easily cut a safety belt in case of emergency without hurting the careless users, especially the children.

Please refer to FIG. 1. A conventional life-saving hammer 10 is made up of hammer head 11 disposed at the upper section thereof, a receiving groove 12 extending downwards at the lower section thereof with a chamber 121 defining the inner side thereof, and a blade 13 pivotally joined at the bottom thereof and adapted at said chamber 121 thereof.

There are some disadvantages to such conventional life-saving hammer 10. First, due to its length, said blade 13 tends to be bent and distorted when drawn for use, or easily cut the careless users, especially the children. Second, said hammer head 11 is integrally molded and electro-plated, which is quite uneconomical in terms of the cost of materials and processing.

Please refer to FIG. 2. Another conventional life-saving hammer 20 is equipped with a hammer head 21 disposed at the upper section thereof, a slant cut groove 22 disposed at the bottom thereof, and a blade 23 of certain length fixed at the middle of said slant cut groove 22 therein. The drawbacks of such conventional life-saving hammer 20 are as follows:

First, said blade 23 is hidden at said slant cut groove 22 therein, which may cause inconvenience and even danger for the users unfamiliar with its structure. Second, said blade 23 exposed for use at said slant cut groove 22 is so short that it's difficult to dissever a safety belt at the first cut, thus losing the timing of live-saving. Third, said hammer head 21 is integrally molded and electroplated, causing the increase of the cost of materials and processing.

Please refer to FIG. 3. A third conventional life-saving hammer 30 mainly includes a hammer head 31 disposed at the upper section thereof, a slant cut groove 32 disposed at the bottom of said hammer head 31, and a blade 32 of certain length fixed at the middle of said slant cut groove 32 therein.

There are several drawbacks to such conventional life-saving hammer 30. First, due to its insufficient length exposed at said slant cut groove 32, said blade 32 has to be applied several times to cut a safety belt, which is quite inefficient in case of emergency. Second, said hammer head 30 has a light weight, which makes it hard to break the glasses for the purpose of life-saving at the first moment. Third, said hammer head 30 is integrally molded and electroplated, which uneconomically boosts the cost of materials and processing.

SUMMARY OF THE PRESENT INVENTION

It is, therefore, the primary purpose of the present invention to provide an improved life-saving hammer structure, comprising a left and a right housings, a hammer head, a counterweight block, and a blade wherein said hammer head is facilitated by said counterweight block whose weight helps to accelerate the hitting power of said hammer head to the maximum so as to smash the glasses for the purpose of life-saving at the very first moment.

It is, therefore, the second purpose of the prevent invention to provide an improved life-saving hammer structure wherein said blade is protected by a pair of left and right handles disposed at the lower section of said left and right housings, preventing the users, especially the children, from cutting themselves carelessly.

It is, therefore, the third purpose of the present invention to provide an improved life-saving hammer structure wherein said hammer head is separated from said counterweight block and adapted to a pair of left and right transverse arc coupling heads disposed at the upper section of said left and right housings respectively, economically reducing the cost of material and electroplating of said hammer head thereof.

It is, therefore, the fourth purpose of the present invention to provide an improved life-saving hammer structure wherein said left and right housings engaged therewith provide a proper space at the handle section for a safety belt to be slid therein via a guide face so as to cut the safety belt quickly and efficiently at the very first moment for the purpose of life-saving.

DETAILED DESCRIPTION OF THE PREFERRED EMBODIMENT

Figure 4:
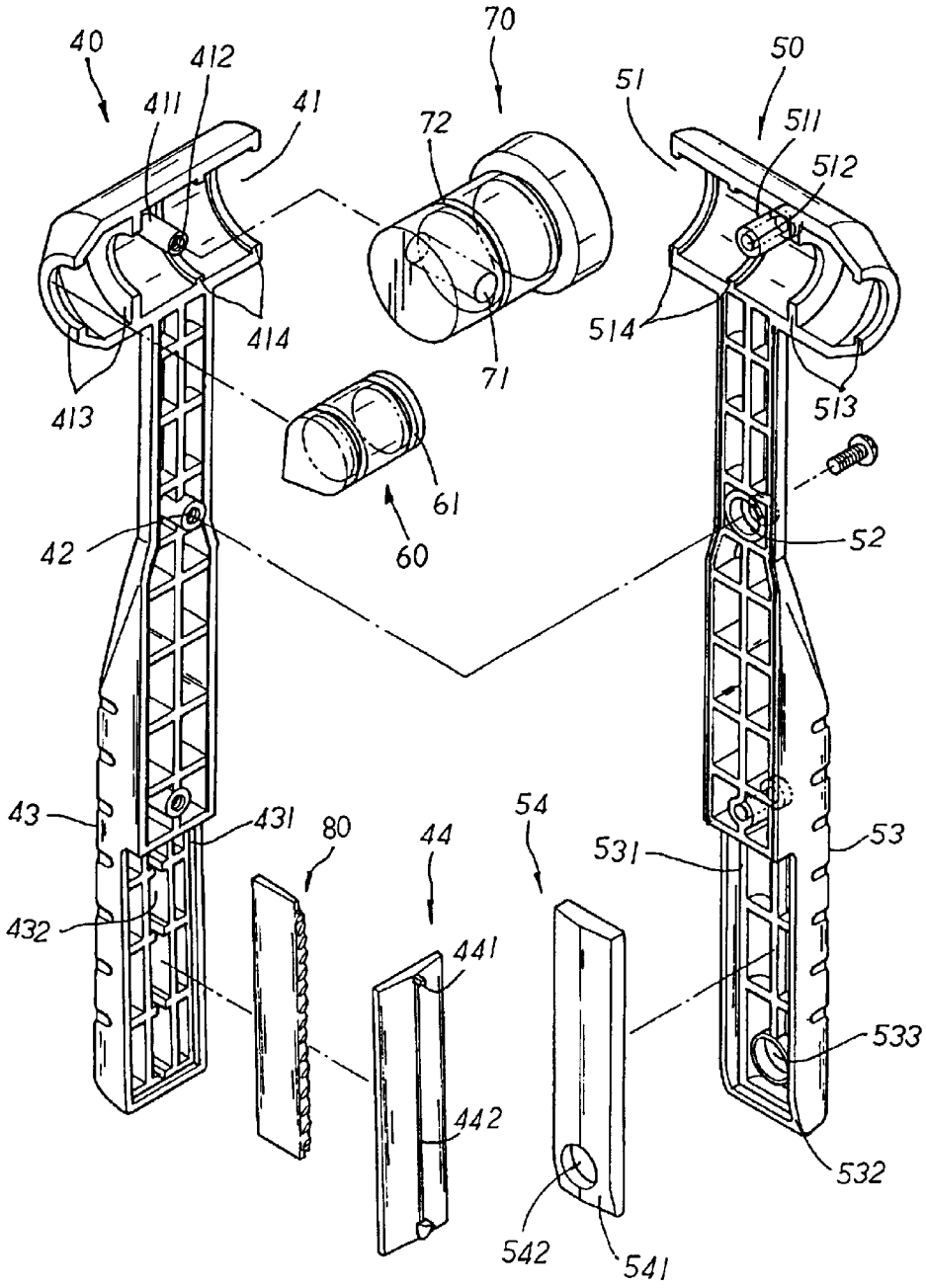
FIG. 4 is a perspective exploded view of the present invention.

Please refer to FIG. 4. The present invention is related to an improved life-saving hammer structure, comprising a left and a right housings 40, 50, a hammer head 60, a counterweight block 70, and a blade 80. Said left and right housings 40, 50 are counterparts to be engaged therewith. A pair of left and right transverse arc coupling heads 41, 51 are disposed at the upper section of said left and right housings 40, 50 thereof. Each of said left and right transverse arc coupling heads 41, 51 is equipped with a fixing post 411 (511) with a screw hole 412 (512) disposed thereon, and a multiple of abutting ribs 413, 414 (513, 514) distributed properly at both side of said fixing post 411 (511) at the inner walls thereof. Each of said left and right housings 40, 50, also includes a middle section, extending vertically downwards at the bottom of said left and right transverse arc coupling heads 41, 51 with a multiple of corresponding equidistant engaging holes 42, 52, disposed thereon, and a staged lower section, extending downwards at the bottom of said middle section thereof. A left and a right handles 43, 53 of unequal length are disposed at the staged lower section of said left and right housings thereof respectively.

Said left and right handles 43, 53, are provided with staged stop flanges 431, 531, each defining the inner periphery thereof, for a left and a right cover bodies 44, 45 to be engaged thereon respectively. Said left handle 43 thereof has a vertical receiving slot 432 disposed at the center thereof for said blade 80 thereof to be engaged therein at one side, and said right handle 53 is provided with a guide member 532 disposed at the bottom inner edge thereof. Said left cover body 44 thereof has a pair of locating blocks 441 disposed correspondingly at both top and bottom edges thereof and a clearance 442 disposed at the middle section defined by both said locating blocks 441 thereof. Said right cover body 54 is provided with a guide face 541 disposed at the bottom edge thereof matching to said guide member 532 thereof, and a first hanging hole 542 corresponding to a second hanging hole 533 disposed at the lower section of said right handle 53 thereof. Said hammer head 60, tapered-pointed at the front, is defined by a multiple of fixing grooves 61 at the periphery thereof, while said counterweight block 70, a block body of proper weight with a staged column projecting at the front thereof, is equipped with a through hole 71 disposed properly at the front end thereof and a multiple of locating grooves 72 defining the periphery of said staged column at one side of said through hole 71 thereof.

Figure 2:
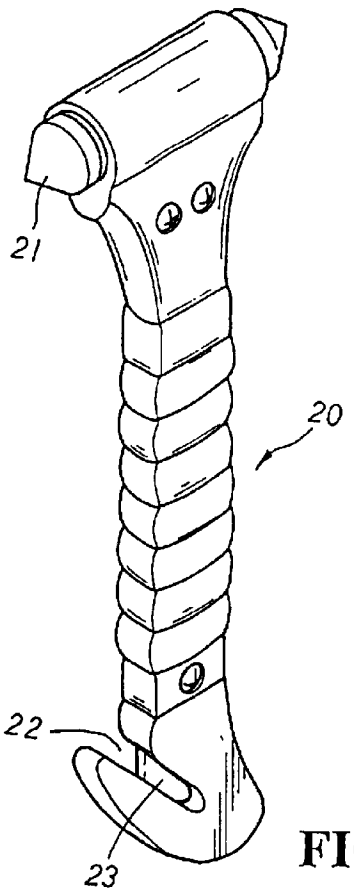
FIG. 2 PRIOR ART
FIG. 2 is a perspective view of another conventional life-saving hammer.
Figure 1:
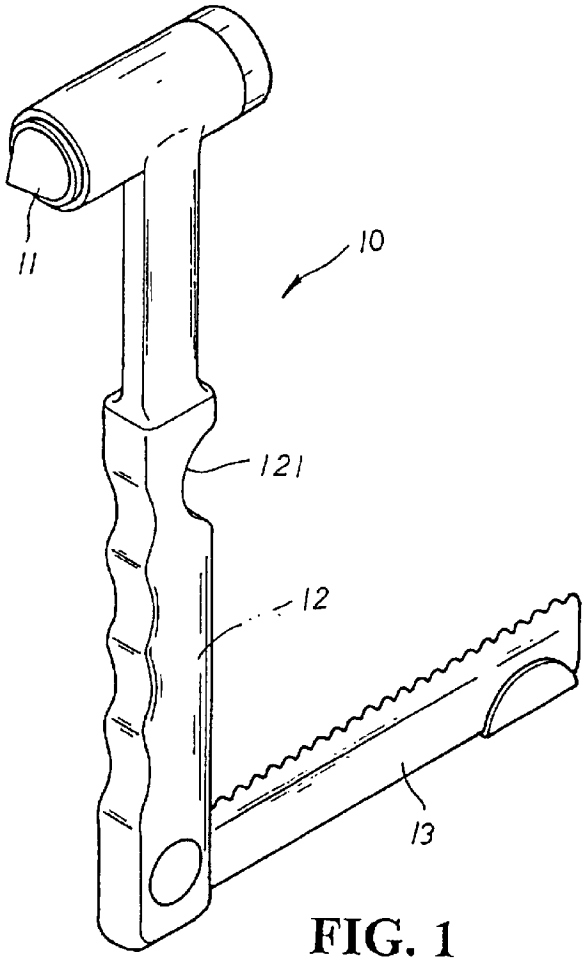
FIG. 1 PRIOR ART
FIG. 1 is a perspective view of a conventional life-saving hammer.
Figure 7:
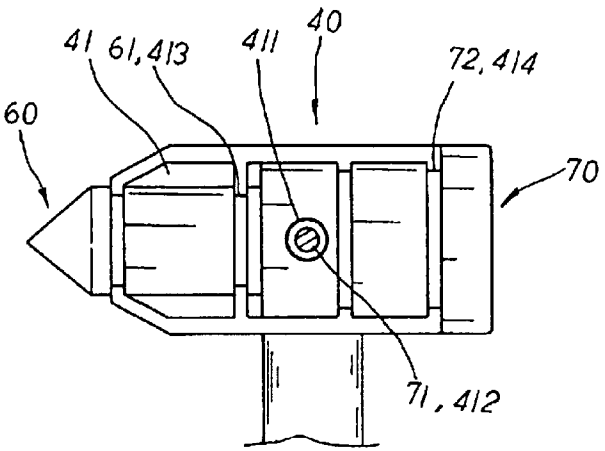
FIG. 7 is a partially sectional view of the present invention in assembly.
Figure 3:
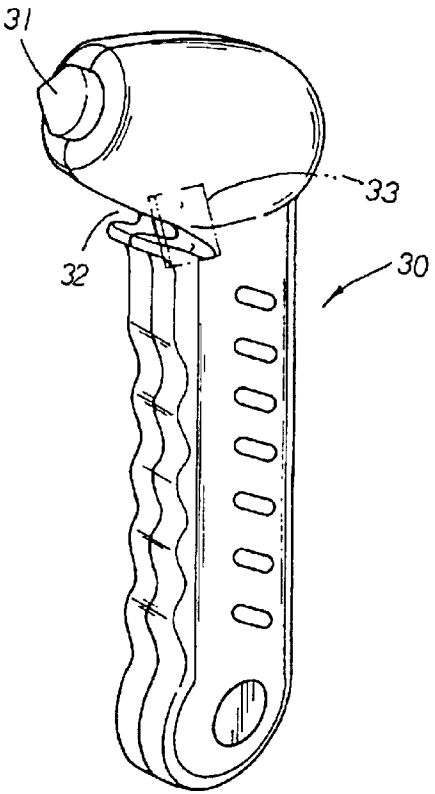
FIG. 3 PRIOR ART
FIG. 3 is a perspective view of a third conventional life-saving hammer.
Figure 5:
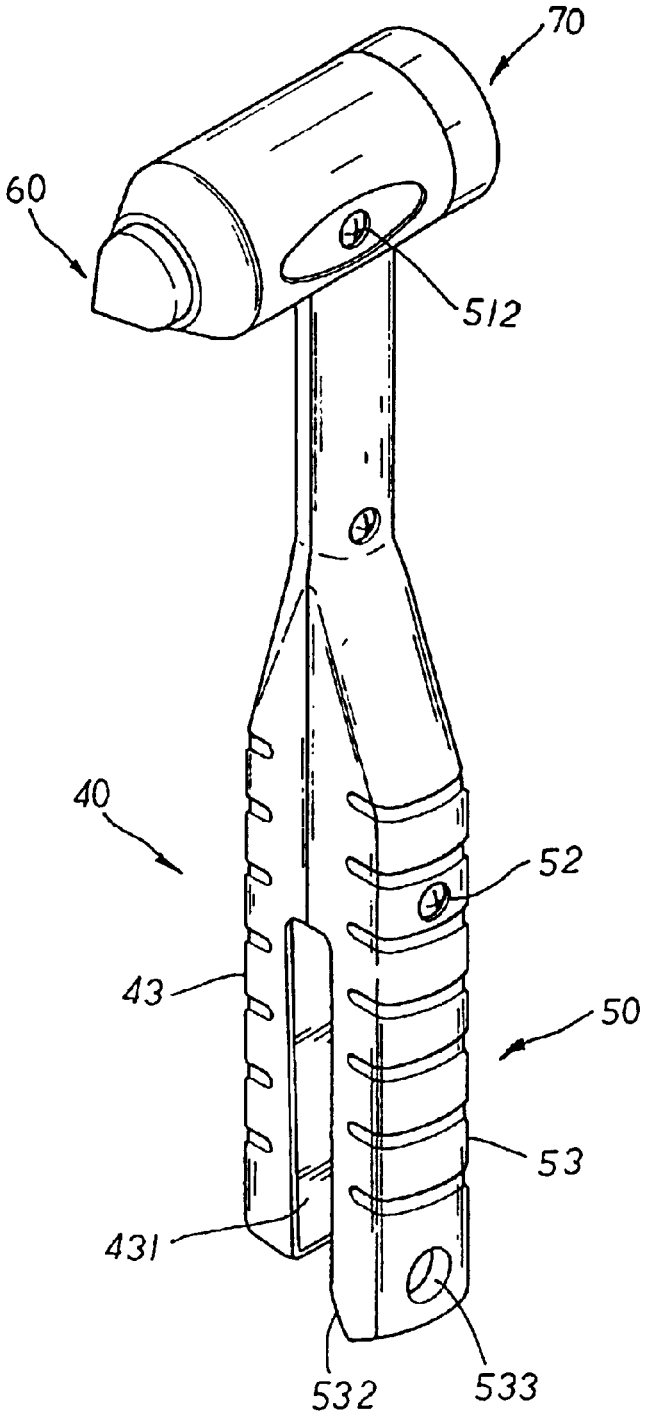
FIG. 5 is a perspective view of the present invention in assembly.
Figure 6:
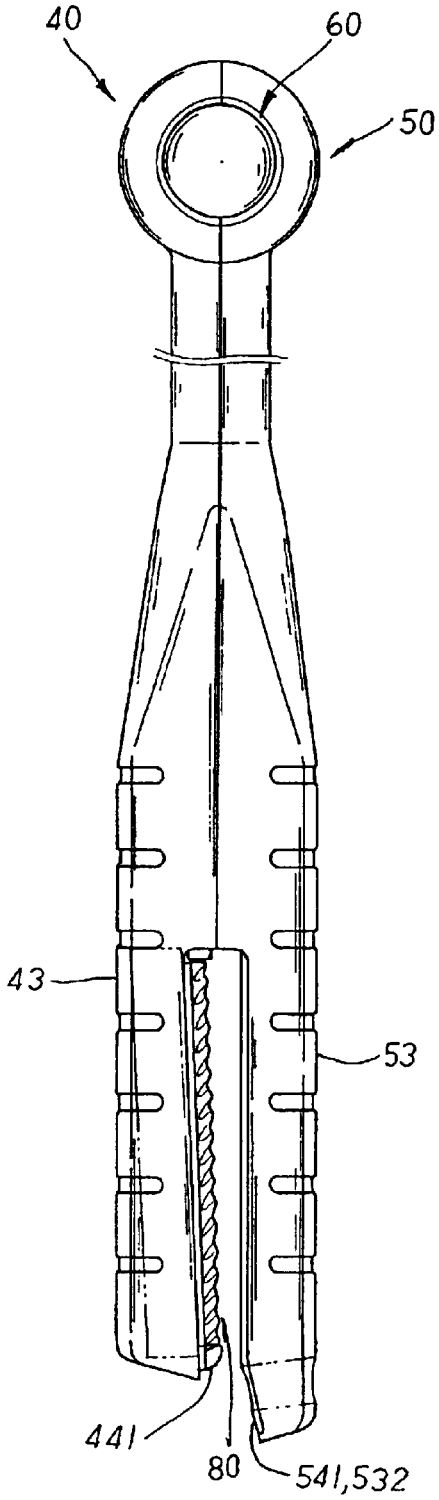
FIG. 6 is a sectional view of the present invention in assembly.

Please refer to FIGS. 5, 6. In assembly, said right cover body 54 is abutted against the staged stop flange 531 of said right handle 53 thereof, while said left cover body 44, after said blade 80 being engaged with the vertical receiving slot 432 of said left handle 43 thereof at one side, is placed onto the staged stop flange 431 thereof with said blade 80 projecting out of said clearance 441 at the other side and clamped by said locating blocks 441 thereof at both top and bottom edges thereof. The fixing grooves 61 of said hammer head 60 are then engaged with the abutting ribs 413 of said left transverse arc coupling head 41 thereof, and the through hole 71 of said counterweight block 70 is joined to the fixing post 411 thereof from one side with said locating grooves 72 thereof engaged with said abutting ribs 414 thereof. The fixing post 511 of said right transverse arc coupling head 51 thereof is then led through the through hole 71 of said counterweight block 70 from the other side with the abutting ribs 513, 514 thereof engaged with said fixing grooves 61 and said locating grooves 72 thereof respectively. Said corresponding left and right transverse arc coupling heads 41, 51 are then screw joined via a screw led through said screw holes 412, 512 thereof to securely encase said hammer head 60 and said counterweight block 70 at the space enclosed by said left and right transverse arc coupling heads 41, 51 thereof as shown in FIG. 7. Said left and right housings 40, 50 are further secured via screws led through said corresponding equidistant engaging holes 42, 52 thereof to complete the assembly of the present invention.

In practical use, said hammer head 60, facilitated by said counterweight block whose weight helps to accelerate the hitting power of said hammer to the maximum, can easily and quickly smash glasses for the purpose of life-saving at the very first moment. Furthermore, said left and right housings 40,50 provide a proper space formed by said left and right handles 43, 53 thereof through which a safety belt, easily slid therein via the guide face 541 of said left cover body 54, can be quickly cut in case of emergency. Besides, said blade 80 is adapted at the inner side of said left handle 43 thereof and protected by both said left and right handles 43, 53, preventing careless users, especially the children, from the danger of cutting themselves.

What is claimed is:

1. A life-saving hammer structure, comprising:

left and right housings, a hammer head, a counterweight block, and a blade wherein said left and right housings are counterparts to be engaged therewith so as to encase said hammer head and counterweight block at the upper section thereof;

said hammer head is taper-pointed at a front portion thereof, said hammer head includes a multiple of fixing grooves disposed at a periphery thereof;

said counterweight block includes a block body with a staged column projecting at a front portion thereof, said block body having a through hole disposed at a front portion thereof and a multiple of locating grooves disposed at one side of said through hole;

said left and right housings equipped with left and right traverse arc coupling heads disposed at an upper section thereof respectively; each of said left and right transverse arc coupling heads having a fixing post with a screw hole disposed thereon to be engaged with the through hole of said counterweight block, and a multiple of abutting ribs distributed properly at both sides of said fixing post thereof to be engaged with the fixing grooves of said hammer head and the locating grooves of said counterweight block thereof so as to encase said hammer head and counterweight block thereto;

said left and right housings also including a middle section, extending vertically downwards at bottom portions of said left and right transverse arc coupling heads with a multiple of corresponding equidistant engaging holes disposed thereon, and a staged lower section, extending downwards at the bottom thereof with left and right handles of unequal length disposed thereon respectively;

said left and right handles thereof having staged stop flanges, each defining an inner periphery thereof, for left and right cover bodies to be engaged thereon respectively; said left handle thereof including a vertical receiving slot disposed at a center thereof for said blade thereof to be fixed therein at one side therein, and said right handle thereof having a guide member disposed at a bottom inner edge thereof corresponding to a guide face of said right cover body;

said left cover body thereof having a pair of corresponding locating blocks disposed at both top and bottom edges thereof and a clearance disposed at a middle section thereof for said blade to be led through another side and clamped thereto by said locating blocks thereof; said right cover body having a first hanging hole corresponding to a second hanging hole disposed at a lower section of said right handle thereof;

whereby said hammer head, facilitated by said counterweight block whose weight helps to accelerate the hitting power of said hammer head to the maximum, can easily and quickly break glass objects, and said left and right handles thereof provide a proper space through which a safety belt slid easily therein via the guide face of said left cover body can be quickly cut in case of an emergency.

* * * * *